US011065520B1

(12) United States Patent
Nguyen

(10) Patent No.: US 11,065,520 B1
(45) Date of Patent: Jul. 20, 2021

(54) SWINGING BOB TOY WITH CONFIGURABLE, MULTI-COMPONENT TETHERING MEANS

(71) Applicant: Anthony Mai Nguyen, Sherman Oaks, CA (US)

(72) Inventor: Anthony Mai Nguyen, Sherman Oaks, CA (US)

( * ) Notice: Subject to any disclaimer, the term of this patent is extended or adjusted under 35 U.S.C. 154(b) by 0 days.

(21) Appl. No.: 16/185,012

(22) Filed: Nov. 9, 2018

Related U.S. Application Data

(63) Continuation-in-part of application No. 15/889,895, filed on Feb. 6, 2018, now abandoned.

(60) Provisional application No. 62/456,669, filed on Feb. 9, 2017.

(51) Int. Cl.
*A63B 67/08* (2019.01)
*A63H 33/18* (2006.01)
*A63B 67/10* (2006.01)

(52) U.S. Cl.
CPC ..... *A63B 67/08* (2013.01); *A63B 67/10* (2013.01); *A63H 33/18* (2013.01); *A63B 2225/74* (2020.08)

(58) Field of Classification Search
CPC ... A63B 67/08; A63B 67/10; A63B 21/00043; A63H 33/18; A63H 1/32; G09B 15/06; A63F 2007/4087
See application file for complete search history.

(56) References Cited

U.S. PATENT DOCUMENTS 1,932,943 A * 10/1933 Smith ..... A63B 67/10 446/247
3,966,204 A * 6/1976 Dubach ..... A63B 21/00 482/93
4,813,685 A * 3/1989 Gaston ..... A63F 7/382 473/576
4,878,868 A * 11/1989 Shaw ..... A63B 67/10 446/75
RE34,208 E * 3/1993 Shaw ..... A63B 67/10 426/104
6,896,578 B2 * 5/2005 Shaw ..... A63B 43/007 446/247
8,758,080 B1 * 6/2014 Kerzic ..... A63B 67/08 446/490

(Continued)

*Primary Examiner* — Eugene L Kim
*Assistant Examiner* — Alyssa M Hylinski
(74) *Attorney, Agent, or Firm* — Integral Patent; Laurence J. Shaw

(57) ABSTRACT

A swinging bob toy having a first outer bob attached to a first outer looped tethering means, a second outer bob attached to a second outer looped tethering means, and a central bob attached to a central looped tethering means, the first outer looped tethering means being attached at an outer end of a first segment of the central looped tethering means, and the second outer looped tethering means being attached at an outer end of a second segment of the central looped tethering means. The outer looped tethering means are attached to the central looped tethering means by means of half hitches, the outer looped tethering means are attached via apertures in the bobs by means of half hitches, thereby allowing the toy to be rapidly disassembled and reassembled, possibly with the incorporation of components from additional toys, in other configurations. The central looped tethering means is a non-hollow string while the outer looped tethering means are coreless tethering means which generally take a flattened state.

7 Claims, 13 Drawing Sheets

(56) References Cited

U.S. PATENT DOCUMENTS

| | | | | |
|---|---|---|---|---|
| 2004/0198174 | A1* | 10/2004 | Shaw | A63B 43/007 446/490 |
| 2006/0094573 | A1* | 5/2006 | Week | A63B 21/0552 482/126 |
| 2010/0015883 | A1* | 1/2010 | Boudreaux | A63H 1/32 446/253 |
| 2014/0179499 | A1* | 6/2014 | Weber | A61H 1/0274 482/131 |
| 2016/0001121 | A1* | 1/2016 | Riley | A63B 21/00043 482/110 |
| 2018/0036604 | A1* | 2/2018 | Walterscheid | A63B 43/06 |

* cited by examiner

SWINGING BOB TOY WITH CONFIGURABLE, MULTI-COMPONENT TETHERING MEANS

RELATED APPLICATIONS

The present application is based on and claims priority to nonprovisional patent application Ser. No. 15/889,895 by Anthony Mai Nguyen filed Feb. 6, 2018 entitled "Swinging bob toy with configurable, multi-component tethering means," which is in turn based on and claims the priority of provisional patent application Ser. No. 62/456,669 by Anthony Mai Nguyen filed Feb. 9, 2017 entitled "Light Emitting Juggling Rope".

FIELD OF THE INVENTION

The present invention relates to skill toys and dexterity toys, and more particularly to toys having swinging/orbiting bobs on a string. The present invention also relates to modular or configurable toys.

BACKGROUND OF THE INVENTION

A popular category of skill/dexterity toys are those which involve one or more swinging bobs. Poi and kendama are two well-known examples of such toys, and a number of new swinging/orbiting bob toys have been developed and commercialized in recent years. These swinging bob toys have a variety of geometries, their particular geometries determining the tricks and maneuvers which can be performed. Hundreds, if not thousands, of different types of orbits, tricks, and moves are possible using these swinging bob toys. While some of the moves are performable on more than one of the above-described swinging bob toys, the particular construction of each toy provides numerous possibilities not available to the other constructions. Although these swinging bob toys have a wide variety of features, it should be noted that none of these include one or more of the following features:

(i) a tethering means which consists of multiple, joined sections, (ii) a tethering means which allows the tethering sections to be joined in a variety of ways to alter the length and/or geometry of the tethering, and (iii) a tethering means where tethering sections have different constructions, such as different thicknesses, weights, flexibilities, softnesses, etc.

It is therefore an object of the present invention to provide a swinging bob toy which permits new types of moves, tricks, motions, and/or orbits to be performed.

It is another object of the present invention to provide a swinging bob toy which provides a variety of modes of play.

It is another object of the present invention to provide a swinging bob toy with an alterable geometry.

Furthermore, it is an object of the present invention to provide a swinging bob toy where the geometry of the toy is easily alterable.

Furthermore, it is an object of the present invention to provide a swinging bob toy with an alterable number of bobs.

It is another object of the present invention to provide a swinging bob toy where the tethering means has multiple sections.

Furthermore, it is an object of the present invention to provide a swinging bob toy with a tethering means having multiple sections where sections have different constructions.

Furthermore, it is an object of the present invention to provide a swinging bob toy having a tethering means with multiple sections having different constructions where one or more sections are located and have a construction adapted to undergo twisting of the tethering means.

Furthermore, it is an object of the present invention to provide a swinging bob toy having a tethering means with multiple sections having different constructions where one or more sections are located and have a construction for minimization of the air resistance during operation.

Furthermore, it is an object of the present invention to provide a swinging bob toy having a looped tethering means which can be easily grasped even when multiple segments are stacked.

It is another object of the present invention to provide a swinging bob toy having bobs constructed such that air resistance during operation is minimized.

It is another object of the present invention to provide a swinging bob toy having bobs attached to tethering means where the bobs and the tethering means are constructed and connected such that air resistance during operation is minimized.

Furthermore, it is an object of the present invention to provide a swinging bob toy with a tethering means having multiple sections where at least one section is made of a material with a non-hollow, substantially cylindrical cross-section and at least one section is hollow.

Furthermore, it is an object of the present invention to provide a swinging bob toy with a tethering means having multiple sections where at least one section has a material which maintains a cylindrical cross-section under twisting and at least one section has a generally flattened material which has edges forming helixes when subject to twisting.

It is another object of the present invention to provide a swinging bob toy with light-up bobs where the bobs are shaped so as to minimize the painfulness of impacts of the bobs on the player.

Furthermore, it is an object of the present invention to provide a swinging bob toy having a tethering means with multiple sections having different constructions, where one or more sections are located and have a construction allowing gripping or handling in multiple fashions.

Additional objects and advantages of the invention will be set forth in the descriptions which follow, and will be obvious from the descriptions or may be learned by practice of the invention. The objects and advantages of the invention may be realized and obtained by means of the instrumentalities and combinations particularly pointed out in the claims.

SUMMARY OF THE INVENTION

The present invention is directed to a swinging bob toy having a looped first tethering means, a first bob attached to the first tethering means, a looped second tethering means attached to the first tethering means, and a second bob attached to the second tethering means.

DETAILED DESCRIPTION OF THE PREFERRED EMBODIMENTS

According to the lexography of the present specification, the term "string" means any flexible, elongated tethering means, such as what might be referred to as cord, twine, rope, wire, yarn, thread, etc., whether braided, woven, twisted, hybrid, or otherwise.

Figure 1:
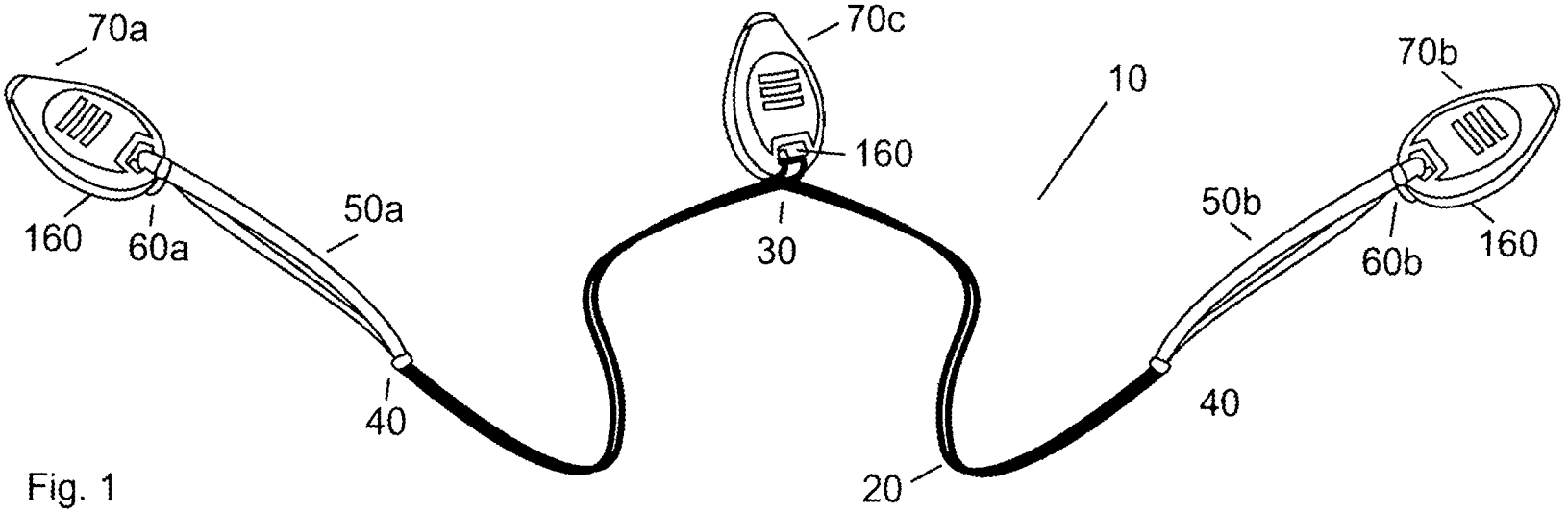
FIG. 1 shows a first preferred embodiment of the toy of the present invention where a central bob is secured to a central loop, and first and second end bobs are secured to outer loops.
Figure 2A:
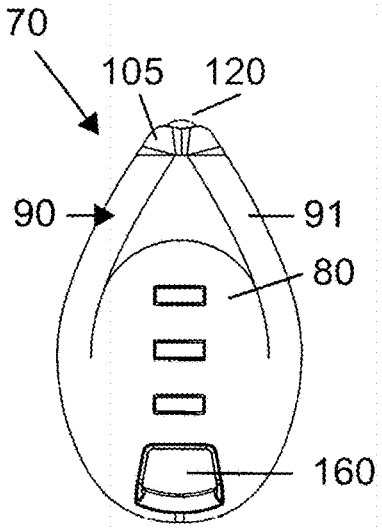
FIG. 2A shows a bottom plan view of a bob according to the present invention, the bob having a translucent casing and internal light-emitting components.
Figure 2B:
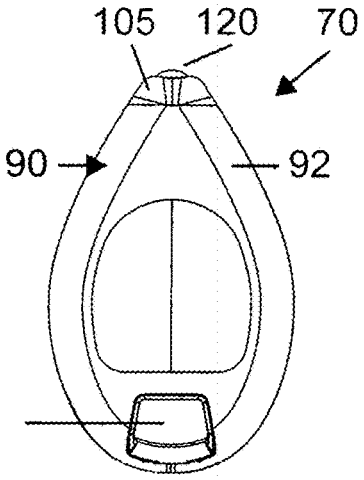
FIG. 2B shows a top plan view, with a mode control button visible, of the bob of FIG. 2A.
Figure 2C:
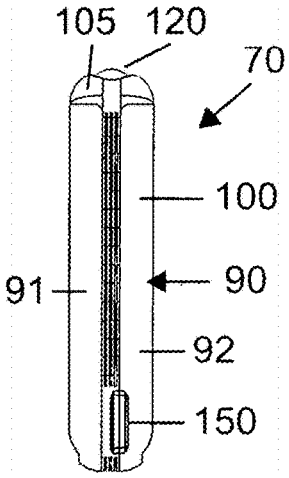
FIG. 2C shows a right side view, with the release slot visible, of the bob of FIG. 2A.
Figure 2D:
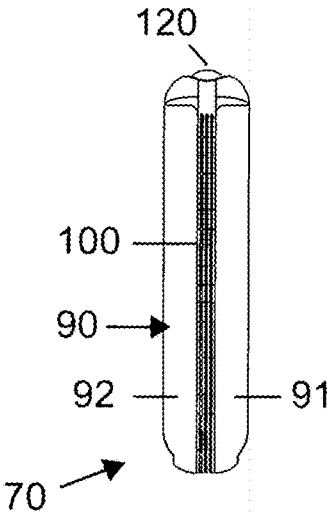
FIG. 2D shows a left side view of the bob of FIG. 2A.
Figure 2E:
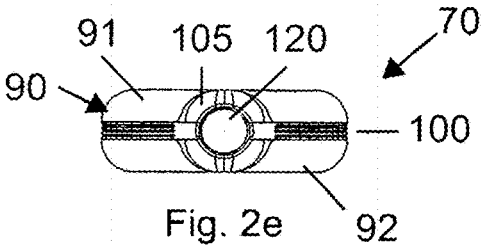
FIG. 2E shows a front view of the bob of FIG. 2A.
Figure 2F:
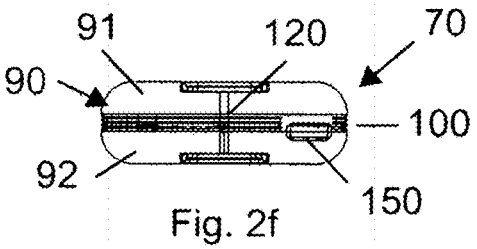
FIG. 2F shows a rear view, with the release slot visible, of the bob of FIG. 2A.

FIG. 1 shows a first preferred embodiment of the swinging bob toy (100) of the present invention. The toy (100) has a central loop (20) of string, a first outer loop (50*a*), and a second outer loop (50*b*). Secured at the center of the central loop (20) is a central bob (70*c*), secured to the first outer loop (50*a*) is a first outer bob (70*a*), and secured to the second outer loop (50*b*) is a second outer bob (70*b*). It should be noted that according to the present invention the bobs (70) may have light-up components. Hence, the present specification will variously refer to the bobs (70) as bobs or lights.

Figure 3:
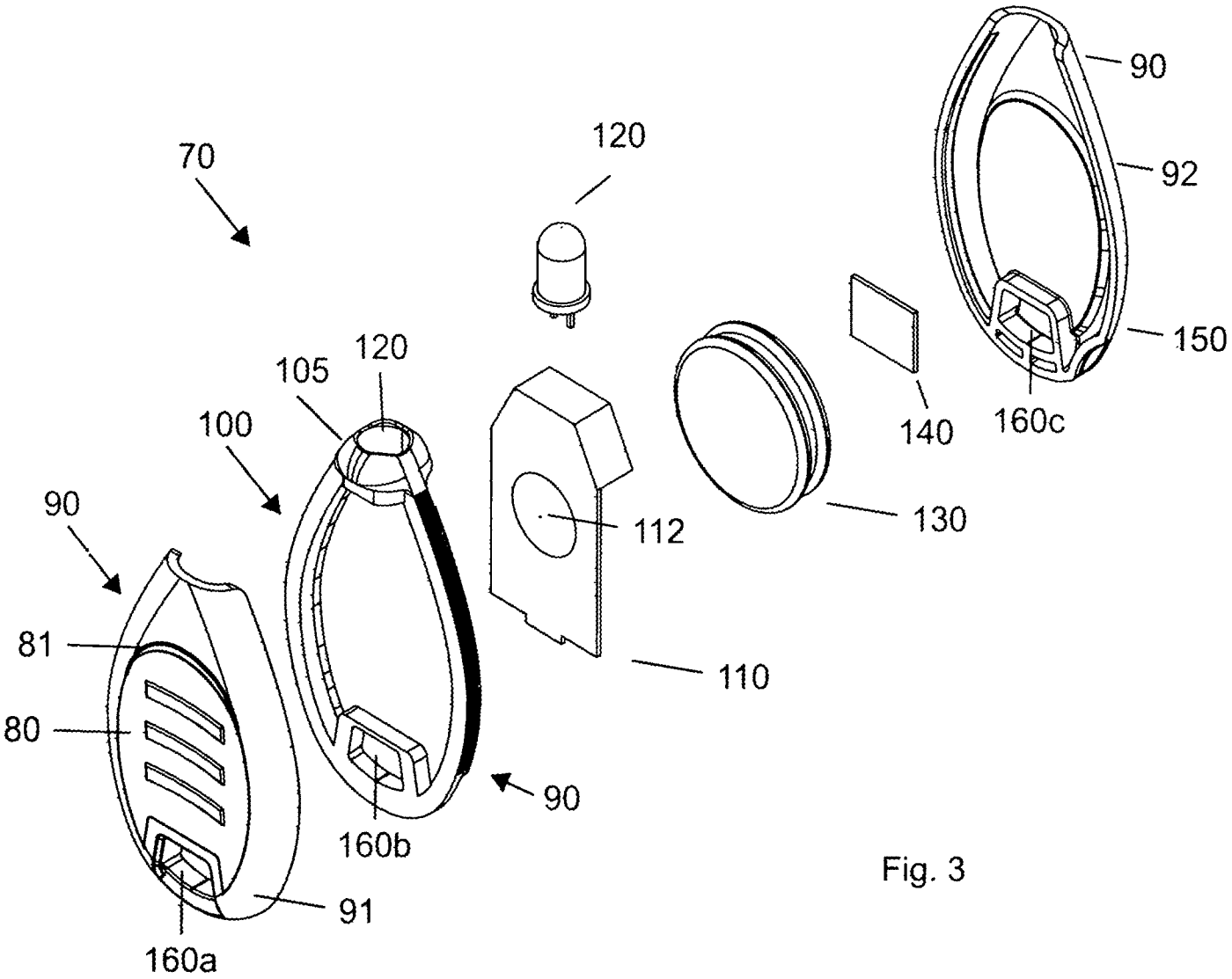
FIG. 3 shows an exploded view of the light-up bob of FIG. 2A.

FIGS. 2*a* through 2*f* show top plan, bottom plan, right side, left side, front, and back views, respectively, of a bob (70) according to the present invention, and FIG. 3 shows an exploded view of the bob (70). (Bobs will be referred to collectively or generically with reference numeral 70, and particular bobs will be referred to with a letter appended to the reference numeral 70. The orientations used for the orientation labeling of FIGS. 2*a*-2*f* above are used for convenience in the present specification when referring to components of the bobs (70) but are arbitrary and not to be considered limiting.)

According to the preferred embodiment of the present invention, each bob (70) has the same construction. Each bob (70) has a substantially flat, transparent casing (90) comprised of a top casing portion (91), a bottom casing portion (92), and a middle casing portion (100), the middle casing portion (100) being sandwiched between the top casing portion (91) and the bottom casing portion (92). As can be taken from FIGS. 2A through 2F by direct measurements on the drawings, the casing (90) is considered flat because the length to thickness aspect ratio is less than or equal to 4.7 to 1, and the width to thickness aspect ratio is less than or equal to 2.8 to 1. The top casing portion (91) has a tether bay (160*a*) at its rear end, the bottom casing portion (92) has a tether bay (160*b*) at its rear end, and the middle casing portion (100) has a tether bay (160*c*) at its rear end, the tethering bays (160*a*), (160*b*), and (160*c*) being aligned when the bob (70) is assembled to provide an aperture to be used as a tethering bay (160). At the front end of the middle casing portion (100) is a light-emitting diode ("LED") chassis (105) for seating a light-emitting diode (120). The LED chassis (105) is adapted to facilitate spreading of the light emitted by the light-emitting diode (120) over an increased range of solid angle. The light-emitting diode (120) is seated on and electrically connected to a circuit board (110). The bottom casing portion (92) is sonically welded to the middle casing portion (100), and mating snap-fit mechanisms (not shown) on the top and middle casing portions (91) and (100) allow the top casing portion (91) to be removeably attached to the middle casing portion (100) so that the battery (130) can be replaced when it expires. Along the bottom rear of the top casing portion (91) is a separation bay (150) into which (150) a screw driver or the like can be inserted and pivoted or twisted to produce a separating force to separate the top and middle casing portions (91) and (100).

The top casing portion (91) has a control button (80) which is integrally formed with the top casing portion (91). At the end of the control button (80) opposite the tethering bay (160*a*) is an arced aperture (81) which allows the control button (80) to be pivoted downwards with the pivot region being a region near the tethering bay (160*a*). The middle casing portion (100) seats the LED (120) and circuit board (110) via a friction fit between the LED (120) and the LED chassis (105). The circuit board (110) has a contact pad (112) located underneath the control button (80). Sandwiched between the circuit board (110) and the bottom casing portion (92) is a battery (130) and an impact pad (140). When the button pad (80) is pressed, it contacts the contact pad (112) and forces the contact pad (112) against the battery (130) to cause an electrical connection which changes the state of the lighting of the LED (120). The lighting states of the LED (120) are on, off, and flashing.

Figure 5B:
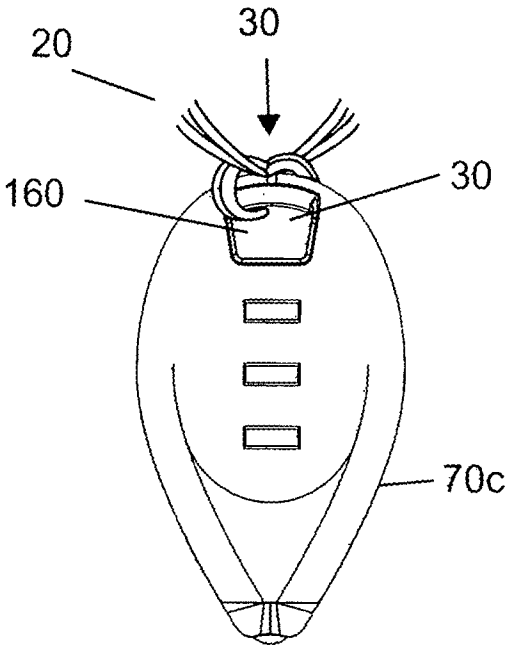
FIG. 5B is a close-up view of the middle bob tethered to the middle loop by an overhand knot.
Figure 5A:
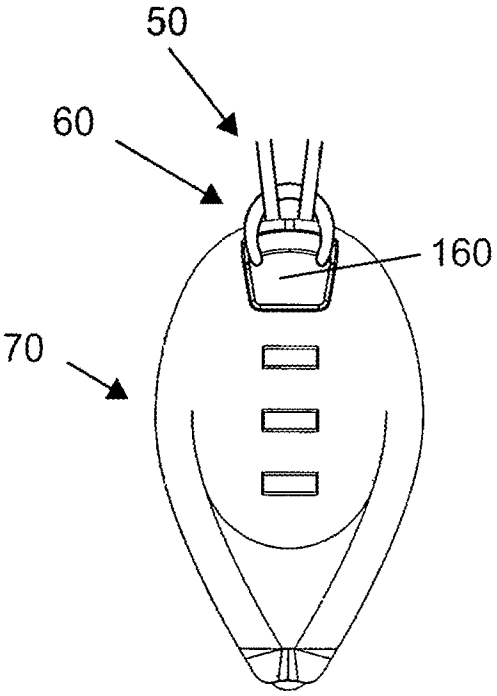
FIG. 5A is a close-up view of an outer bob tethered to an outer loop by a half hitch.
Figure 4:
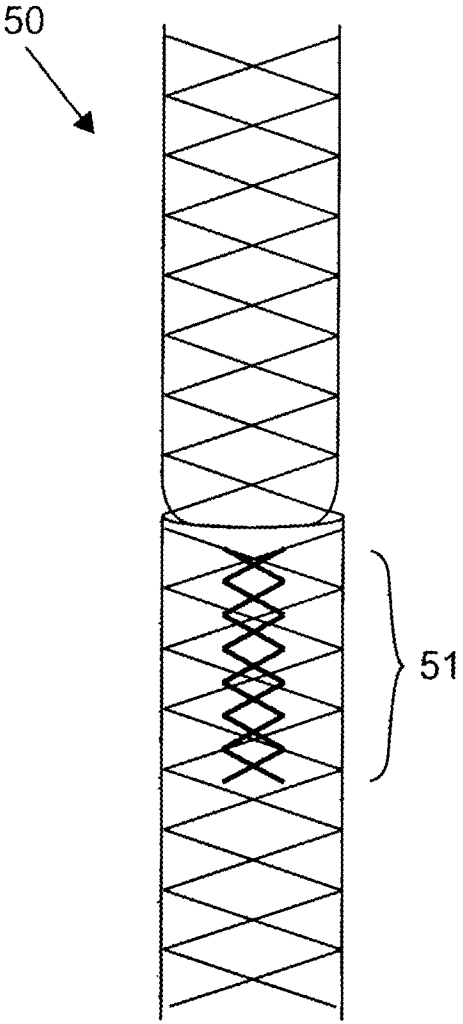
FIG. 4 is a close-up view at the point of attachment showing the coreless sheath of material of the outer loop joined to itself to form a loop.
Figure 5C:
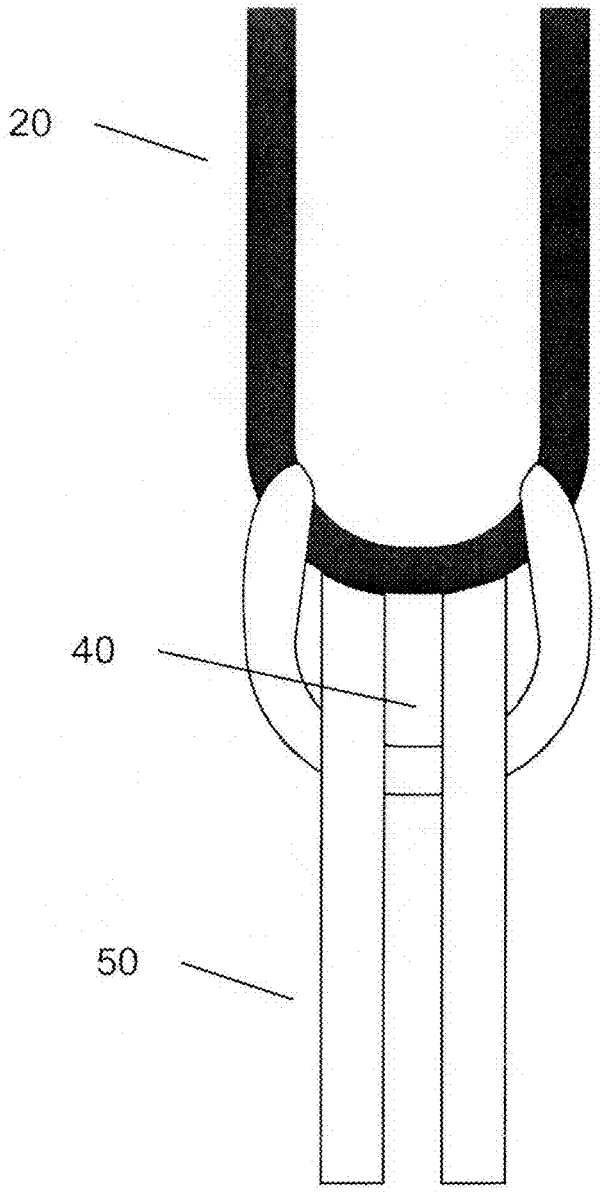
FIG. 5C is a close-up view of a first loop of tethering means attached to a second loop of tethering means using a half hitch.

Each outer bob (70*a*) and (70*b*) is attached to an outer loop (50*a*) and (50*b*) by a half hitch (60*a*) and (60*b*) through the tether bay (160) of the outer bob (70*a*) and (70*b*). FIG. 5A shows a close-up view of a bob (70) attached to an outer loop (50) by a half hitch (60) through the tether bay (160) of the bob (70). Similarly, as is shown in FIG. 5C, each outer loop (50) is attached to the central loop (20) by a half hitch (40) through the central loop (20). According to the preferred embodiment of the present invention, the central loop (20) is a nylon string with a substantially cylindrical weave. More specifically, according to the preferred embodiment, the string of the central loop (20) has a diameter of approximately 2.2 mm, an outer sheath which is a hollow, cylindrical braid of sixteen yarns where each yarn has a diameter of roughly 0.27 mm, and an inner core of a single yarn which substantially fills the hollow of the outer sheath. The topological loop of the central loop (20) is formed by a knot (30), which may be an overhand knot or a square knot. As is shown in the close-up view of FIG. 5B, the knot (30) is lodged in the tether bay (160) of the central bob (70*c*), and an overhand knot additionally secures the middle light (70*c*) to the central loop (20). Alternatively, a square knot may be used instead of an overhand knot. (It should be noted that although the present specification will at times refer to a string having a hollow cylindrical braid or weave as "cylindrical," the term cylindrical in the context of a hollow braid is meant to refer to the topology, but not necessarily the geometry, of the braid/weave, since the topological cylinder may be collapsed to a flattened state. It should also be noted that although the geometries or topologies of the string may be referred to as certain types of weaves, the string, cord or tethering means may or may not be made of a woven material.) Each outer loop (50) is made from a nylon string with a hollow (i.e., coreless), substantially cylindrical weave of 32 yarns where each yarn has a diameter of roughly 0.44 mm. Because of the hollow weave of the outer loops (50), the material is generally in a flattened state. In their flattened states, the material of the outer loops (50) has a width of approximately 4.5 mm. As is shown in FIG. 4, each outer loop (50) is formed from the hollow cylindrical weave by feeding one end of the material into the hollow center of the other end and sewing together the region (51) of overlap to form a functionally seamless joining.

Using a generally flattened-state material for the outer loops (50) and a cylindrical cross-section material for the central loop (20) provides a number of important advantages. When a material with a weave which has a cylindrical cross-section and is not hollow undergoes twisting about its longitudinal axis, it tends to retain its cylindrical cross-section. Furthermore, moderate twisting of a non-hollow, cylindrical cross-section weave does not produce a discernable change in the outer surface of the material. In contrast, a material which is hollow will tend to flatten, and under twisting will have edges which will exhibit a helical twist.

Figure 6:
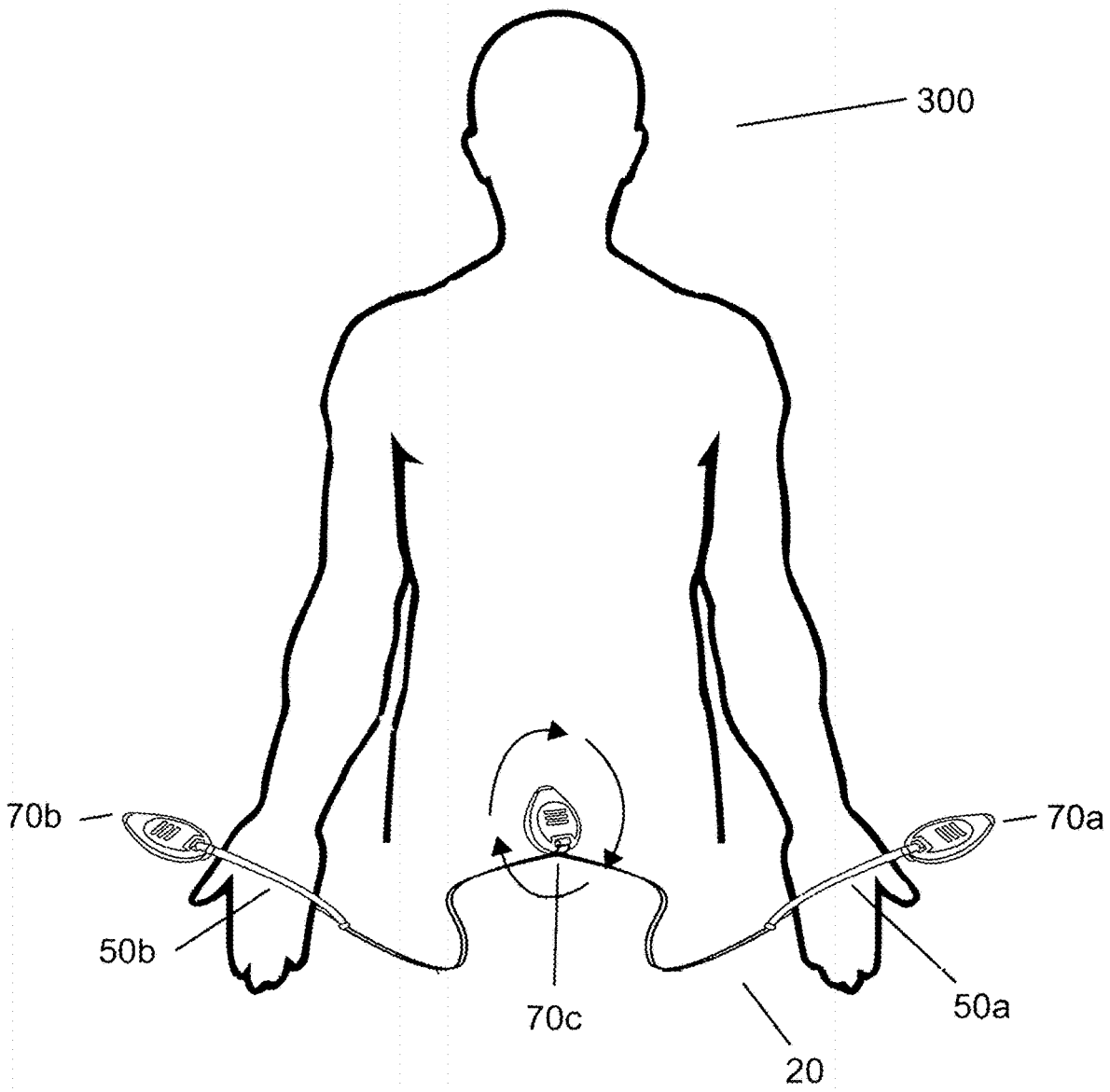
FIG. 6 shows a common maneuver performed with the first embodiment of the toy shown in FIG. 1.

Therefore, according to the present invention a non-hollow, cylindrical cross-section material is used for the central loop (20) because, for moves such as that shown in FIG. 6, where the player (300) puts one hand through each outer loop (50) and spins the central bob (70*c*) in circles, the central loop (20) undergoes substantial twisting. Using a non-hollow, cylindrical cross-section, woven material provides the advantage that, because the cylindrical cross-section is retained under twisting, one section of the material can easily slide over another section even when the sections bear substantial twisting. This is to be contrasted with the resistance that is met when sliding one section of a twisted flattened material over another section of a twisted flattened material. Depending on the degree of twisting and the pressure applied, the resistance may be a high effective coefficient of friction, or even a (momentary or semi-permanent) catching of the materials on each other (i.e., an infinite effective coefficient of friction).

Furthermore, according to the present invention wind resistance of each outer loop (50*a*) and (50*b*) and associated outer bob (70*a*) and (70*b*) is minimized by the geometries of the bobs (70) in combination with the material of the outer loops (50) and with the manner in which the outer loops (50) are attached to the outer bobs (70). In particular, according to the present invention the bobs (70) are substantially flat, the outer loops (50) are made from a material which may flatten, and the knot (60*a*) and (60*b*) used to attach each outer bob (70*a*) and (70*b*) to the associated outer loops (50*a*) and (50*b*) is a half hitch. When swung through the air, an outer bob (70) will tend to orient with an edge of the casing (90) being the forward surface so as to provide a narrow cross-section. This orientation of a bob (70) will also orient the material of the associated outer loop (50) so that an edge of the material is the forward surface, therefore, also minimizing air resistance. It should be noted that another advantage of the flatness of the bobs (70) is that if a bob (70) should strike the player during play, the pain involved is typically reduced because the bob (70) will generally strike at an angle such that it (70) will rotate until the flat top or bottom surface impacts the player, therefore spreading the collision out over a period of time.

As noted above and shown in FIGS. 5A and 5B, each outer bob (70) is attached to an outer loop (50) by a half hitch (60) through the tether bay (160) of the outer bob (70), and each outer loop (50) is attached to the central loop (20) by a half hitch (60) through the central loop (20). The looped sections (20) and (50) provide the important advantage of allowing the tethering means to be held in many more fashions than a simple non-looped tethering means. In particular, in addition to the fashions which a simple non-looped tethering means can be gripped, held, or handled, a looped tethering means can be gripped, held, or handled with one finger, multiple fingers, the entire hand, the wrist, a section of the arm, a foot, the ankle, or possibly even a section of the leg through the loop. This opens up a vast number of new manipulation possibilities. It should also be noted that an advantage of using a hollow material for the outer loops (50) is that the material is generally in its flattened state and provides a larger area of contact with the player's finger, fingers, hand, wrist, arm, etc., thereby providing more comfort and making the contact more easily controllable.

Furthermore, the use of a tethering means formed from looped segments joined by half hitch knots provides the advantage of allowing the tethering loops to be attached and detached from other tethering loops or apertures with rapidity and ease. Furthermore, it should be noted that the joining region (51) in the hollow tether (50) described above with reference to FIG. 4 facilitates the passing of the tether (50) through apertures because the joining (51) has a small cross-sectional area relative to joinings formed by knots. The modular design of the toy of the present invention therefore allows many different embodiments to be constructed. Some exemplary alternate embodiments are shown in FIGS. 7A through 7I.

Figure 7A:
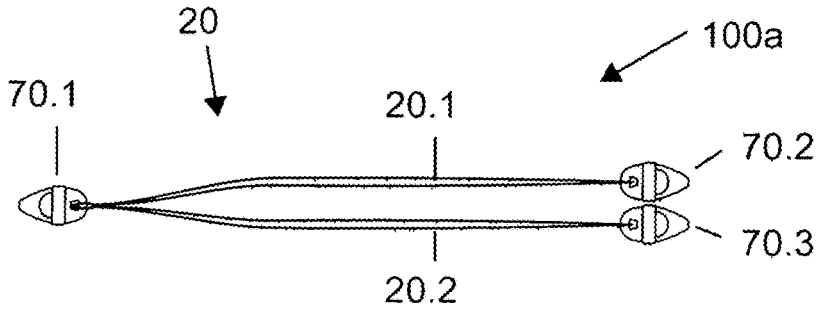
FIGS. 7A through 7I show alternate embodiments of the toy of the present invention having alternate geometries.

FIG. 7A shows a first alternate geometry (100*a*) of the toy according to the present invention where the toy (100*a*) has a central bob (70.1) which is attached at a central point on a coreless looped tethering means (20), and two outer bobs (70.2) and (70.3) which are attached at an outer point on segments (20.1) and (20.2) of the coreless loop tethering means (20). The bobs (70.1), (70.2) and (70.3) are attached to the coreless loop tethering means (20) via half hitch knots.

Figure 7B:
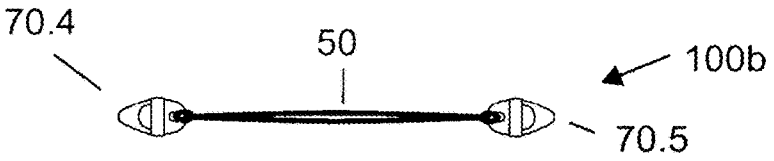
Figure 9:
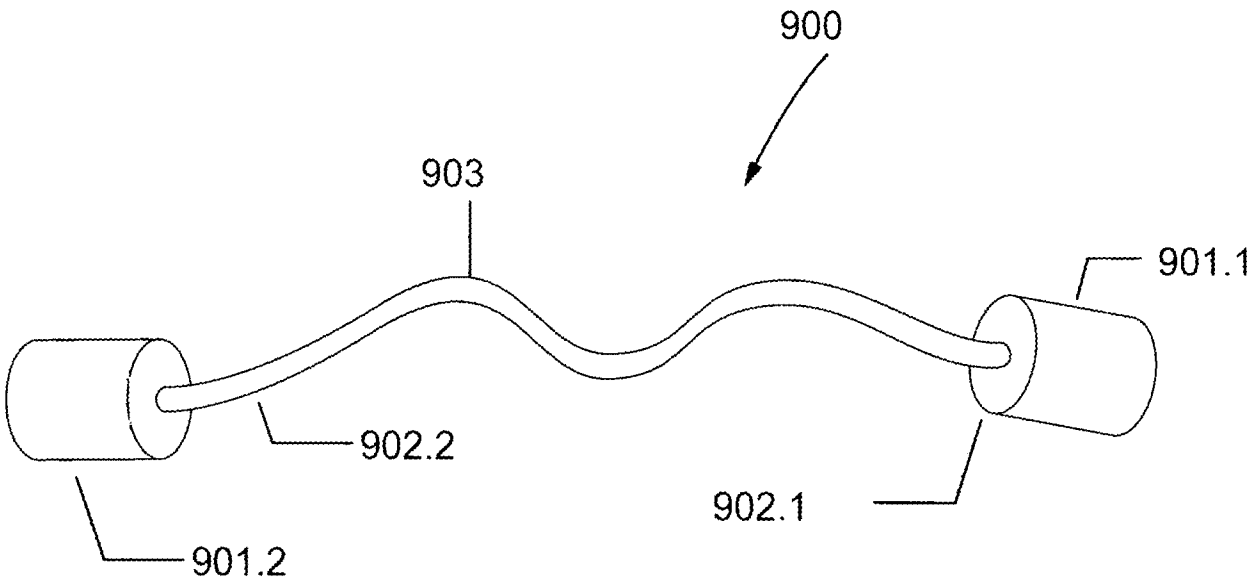
FIG. 9 shows a traditional toy commonly referred to as a begleri.

FIG. 7B shows a second alternate geometry (100*b*) of the toy according to the present invention where the toy (100*b*) has two bobs (70.4) and (70.5) which are attached at distal ends to a hollow, cylindrical cross-section, loop tethering means (50). Each bob (70.4) and (70.5) is attached to the loop tethering means (50) via a half hitch knot. This embodiment (100*b*) can be played with in the manner of the popular toy commonly referred to as begleri. (A begleri toy (900), which has two end bobs (901.1) and (901.2) secured at distal ends (902.1) and (902.2), respectively, of a non-loop tethering means (903) is shown in FIG. 9.) This second alternate geometry (100*b*) is a particularly important alternate geometry because of the popularity of begleri toys (900). Many people know how to play begleri (900), there is a large community of active begleri players, and thousands of begleri videos (which show a large number of possible moves and can be used as tutorials) have been posted online.

Figure 8A:
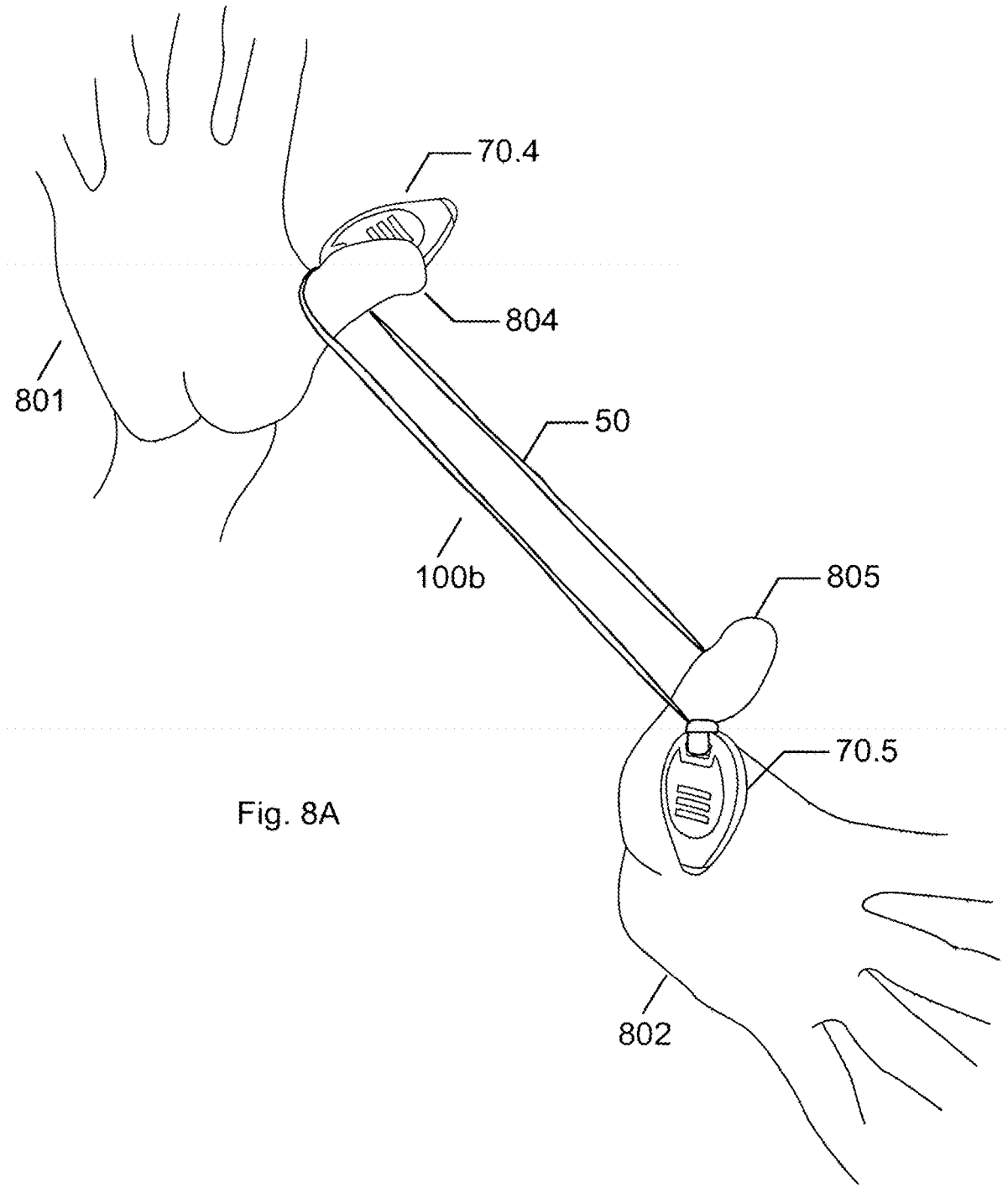
FIG. 8A shows the embodiment of the toy of FIG. 7B with the thumbs of a player inserted into the looped tethering means.

Furthermore, it should be noted that the looped tethering means (50) between the two bobs (70.4) and (70.5) allows for tricks and maneuvers to be performed with this alternate embodiment (100*b*) that are not possible with a begleri toy (900). For instance, as shown in FIG. 8A, the thumbs (804) and (805) of the player can be inserted into the looped tethering means (50). In FIG. 8A the hands (810) and (802) are separated so that the thumbs (804) and (805) are adjacent to the bobs (70.4) and (70.5), respectively. This can be an intermediate or transitionary position, or it can be used as a dramatic stopping point at the end of a routine or between maneuvers.

Figure 8B:
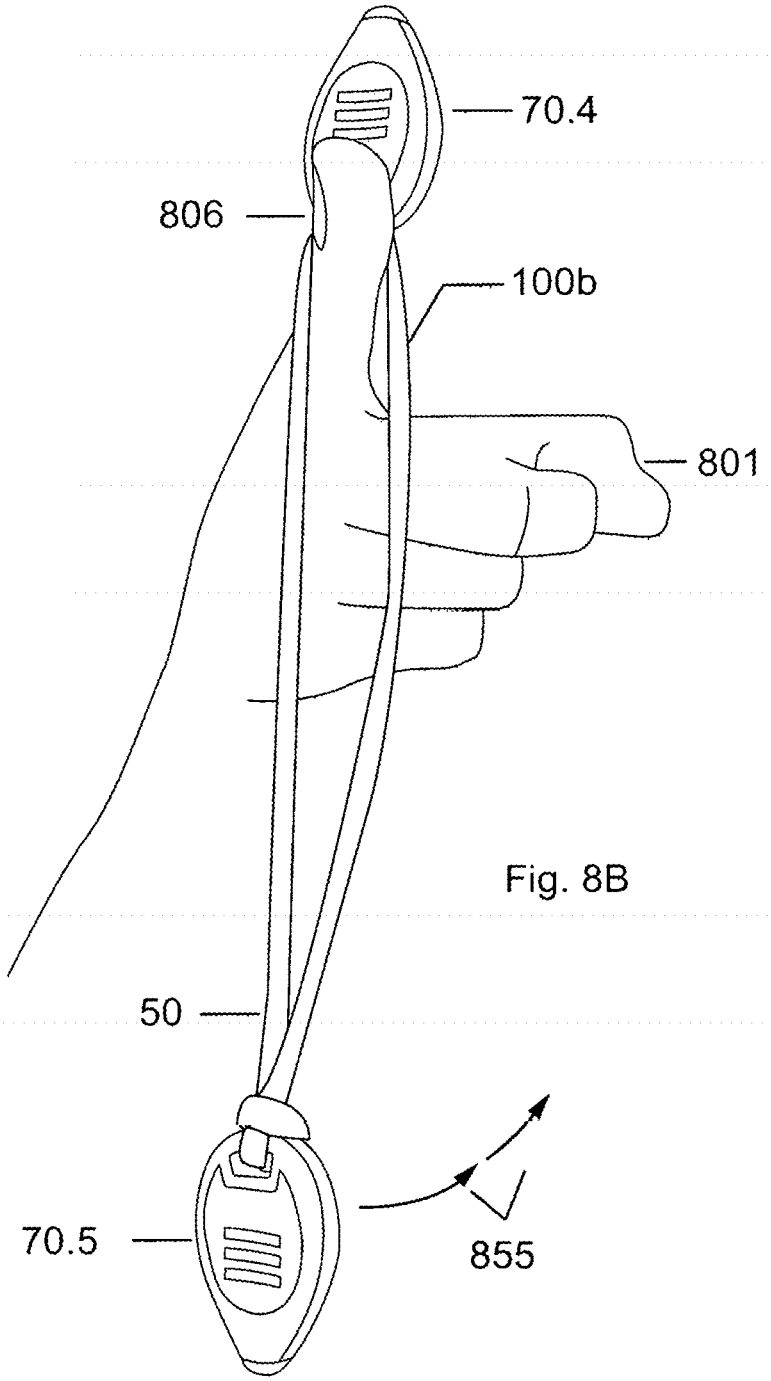
FIG. 8B shows the embodiment of FIG. 7B being spun around a finger of a player.

Although in FIG. 8A the thumbs (804) and (805) of the player are shown inserted into the looped tethering means (50), it should be understood that the looped tethering means (50) also allows one or more fingers or the palm of one or both hands of the player to be inserted into the looped tethering means (50). This facilitates the performance of a myriad of new tricks and maneuvers with this embodiment (100*b*). One of the simplest such maneuvers is shown in FIG. 8B. In FIG. 8B, a finger (806) of the player is inserted into the loop of the looped tethering means (50) and the toy (100*b*) is swung around the finger (as is indicated by the motion arrows (855)) with one bob (70.4) next to the finger (806) and one bob (70.5) distal from the finger (806). This simple move would not be possible if the tethering means (50) was not looped. This maneuver is easy to perform, is visually interesting, and can be performed with the hand in motion or held stationary in a wide variety of positions and orientations. Hence this geometry of the tethering means (50) enables the performance of an important "gateway" move, i.e., a move which beginners can learn it right away and which can be integrated into many more complex maneuvers.

It should be noted that the hollowness of the looped tethering means (50) is particularly advantageous with this embodiment of the toy (100*b*) because a number of important and/or fundamental maneuvers with this two-bob toy (100*b*) involve the tethering means (50) wrapping around or sliding over the hands (801) and (802) (including portions of the hands (801) and (802) such as the fingers, palms, or back of the hands), or involve the tethering means (50) being held between the fingers. As discussed above with reference to FIG. 4, a functionally seamless joint in the hollow tethering means (50) is produced by feeding one end of the material into the hollow center of the other end and sewing together the region (51) of overlap. The hollowness of the looped tethering means (50) allows the looped tethering means (50) to flatten. This provides more comfort when the tethering means (50) is in contact with the skin of the player's fingers, palms, hands, etc. since the contact area is increased by the flattening, thereby alleviating a tendency for the tethering means (50) to dig into the skin. Furthermore, because the contact area is increased, for moves where friction with the hand is required, the flattening may function to increase friction between the tethering means (50) and the hand. Furthermore, because the contact area is increased by the flattening of the tethering means (50), the tethering means (50) is more easily gripped between the fingers.

Figure 8D:
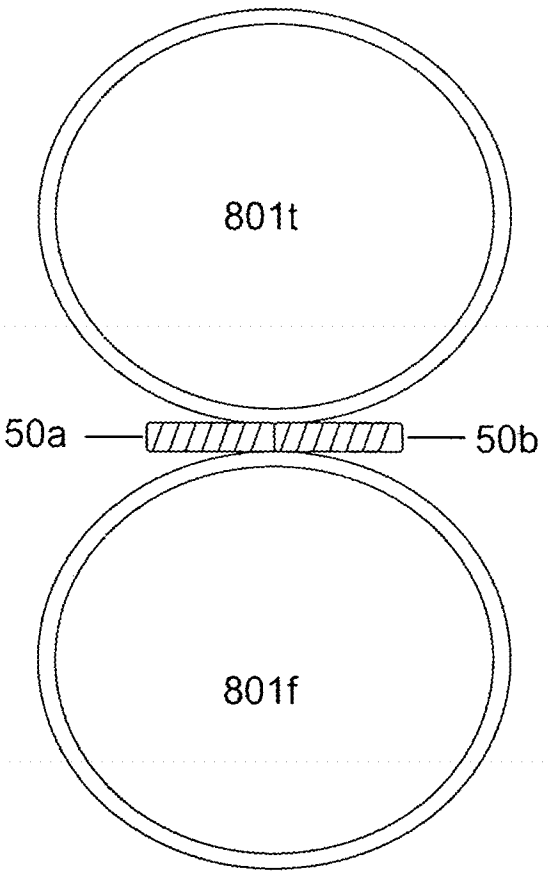
FIG. 8D is a close-up cross-sectional view of two segments of the looped hollow tether means of the embodiment of FIG. 7B being held between the fingers with the two segments side by side.
Figure 8C:
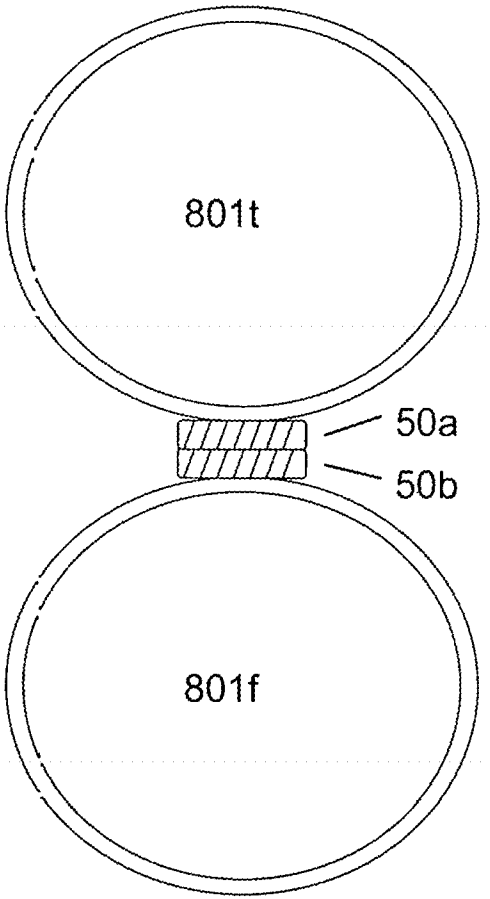
FIG. 8C is a close-up cross-sectional view of two segments of the looped hollow tether means of the embodiment of FIG. 7B being held between the fingers with the two segments stacked.

It should also be noted that because the tethering means (50) is looped, a player will often need to grip two sections of the tethering means (50) simultaneously. As is shown in the magnified, cross-sectional end view of FIG. 8C, two sections (50*a*) and (50*b*) of the flattened tethering means (50) may be gripped between, for instance, the thumb (801*t*) and a finger (801*f*) with the two sections (50*a*) and (50*b*) stacked. Or, as is shown in the magnified, cross-sectional end view of FIG. 8D, two sections (50*a*) and (50*b*) of the flattened tethering means (50) may be gripped between, for instance, the thumb (801*t*) and a finger (801*f*) with the two sections (50*a*) and (50*b*) side by side. Or the two sections (50*a*) and (50*b*) of the flattened tethering means (50) may need to be gripped in some hybrid configuration intermediate between what is shown in FIGS. 8C and 8D. In contrast, it should be noted that two sections of a non-hollow, i.e., round, tethering means, when stacked and pinched between the fingers, is an unstable configuration because two round sections will tend to roll. For sophisticated maneuvers where gripping of the tethering means (50) must be performed quickly and accurately, the flatness of the tethering means (50) therefore provides an important advantage of allowing the tethering means (50) to be easily gripped when in the stacked or side-by-side configurations shown in FIGS. 8C and 8D, or in a hybrid configuration intermediate between what is shown in FIGS. 8C and 8D.

Figure 8E:
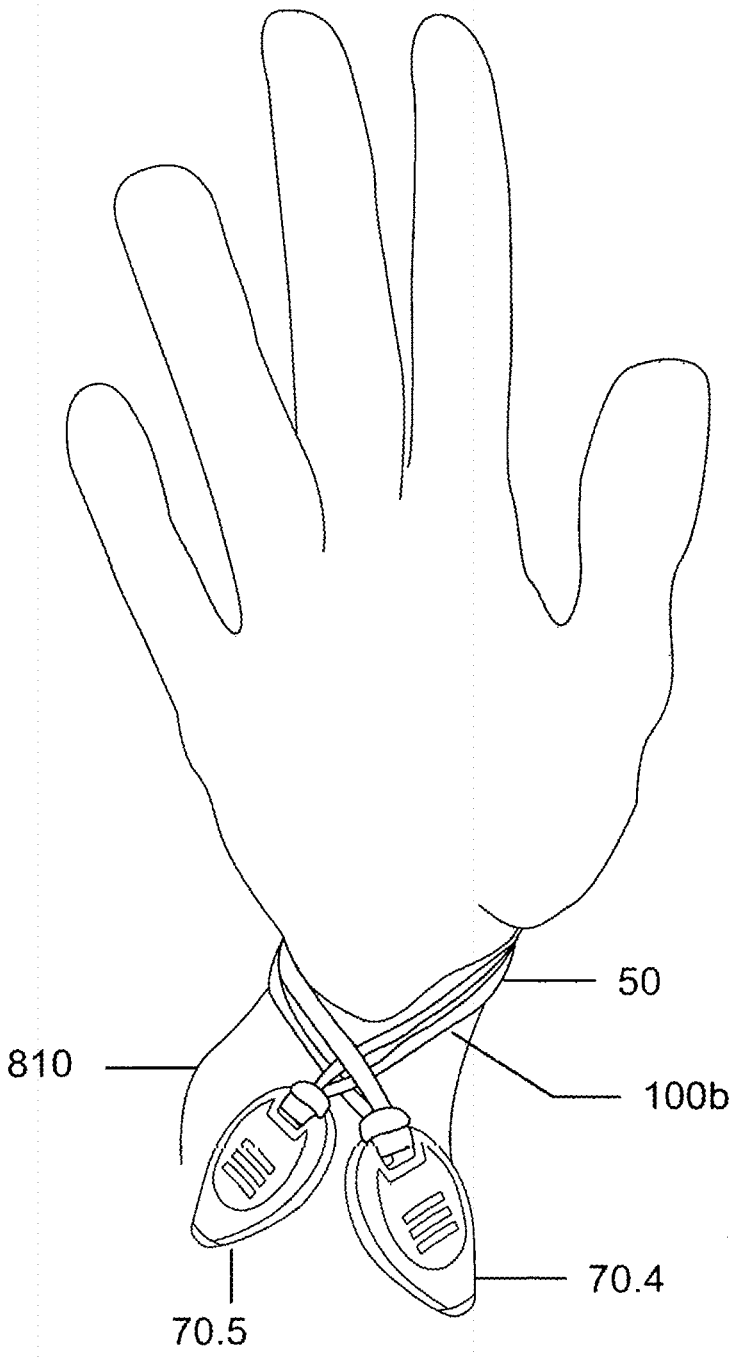
FIG. 8E shows the embodiment of FIG. 7B worn around the wrist of a user.

Furthermore, as shown in FIG. 8E, the alternate embodiment (100*b*) shown in FIG. 7B has the advantage over a begleri toy (900) that it (100*b*) that it (100*b*) can be worn around the players wrist (810). This allows the toy (100*b*) to be easily transported and also increases the visibility of the toy (100*b*) so that interest in its use can spread.

Figure 7C:
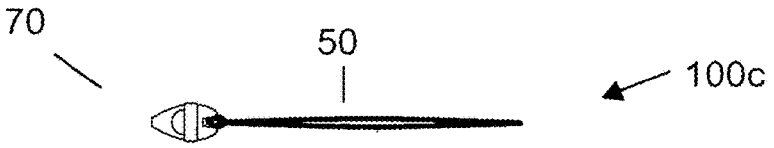

FIG. 7C shows a third alternate geometry (100*c*) of the toy according to the present invention where the toy (100*c*) has a single bob (70) attached to a non-hollow, cylindrical cross-section, loop tethering means (50) via a half hitch knot. With two toys (100*c*) of this geometry, this can be played with in the manner of the popular swinging bob toy commonly referred to as poi.

Figure 7D:
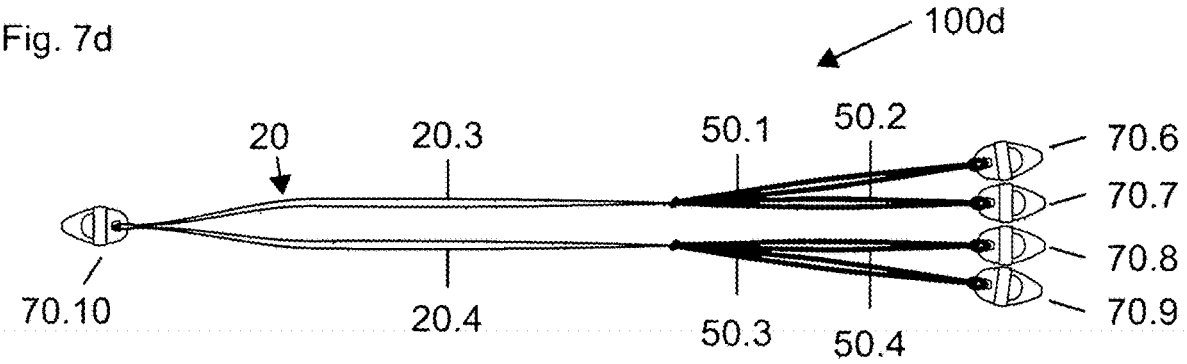

FIG. 7D shows a fourth alternate geometry (100*d*) of the toy according to the present invention where the toy (100*d*) has a central bob (70.10) attached at a central point on a coreless, cylindrical cross-section, loop tethering means (20). In addition, two non-hollow, cylindrical cross-section, loop tethering means (50.1) and (50.2) are attached to a first segment (20.3) of the coreless, cylindrical cross-section, loop tethering means (20) at a first outer point on the coreless loop tethering means (20), and a bob (70.6) and (70.7) is attached to each of the two non-hollow, cylindrical cross-section, loop tethering means (50.1) and (50.2) at an end distal to the end attached to the first segment (20.3) of the coreless loop tethering means (20). Similarly, two non-hollow, cylindrical cross-section, loop tethering means (50.3) and (50.4) are attached to a second segment (20.4) of the coreless loop tethering means (20) at a second outer point on the second segment (20.4), and bobs (70.8) and (70.9) are attached to each of the two non-hollow, cylindrical cross-section, loop tethering means (50.3) and (50.4) at an end distal to the end attached to the first segment (20.4) of the coreless loop tethering means (20). The bobs (70) are attached to the loop tethering means (20) and (50) via half hitch knots, and the non-hollow loop tethering means (50) are attached to the coreless loop tethering means (20) via half hitch knots.

Figure 7E:
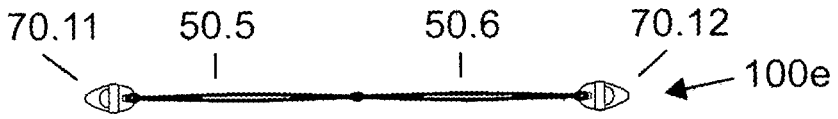

FIG. 7E shows a fifth alternate geometry (100*e*) of the toy according to the present invention where a first bob (70.11) is attached to a first non-hollow, cylindrical cross-section, loop tethering means (50.5) using a half hitch knot, a second bob (70.12) is attached to a second non-hollow, cylindrical cross-section, loop tethering means (50.6) using a half hitch knot, and the first and second non-hollow, cylindrical cross-section, loop tethering means (50.5) and (50.6) are attached to each other using a half hitch knot.

Figure 7F:
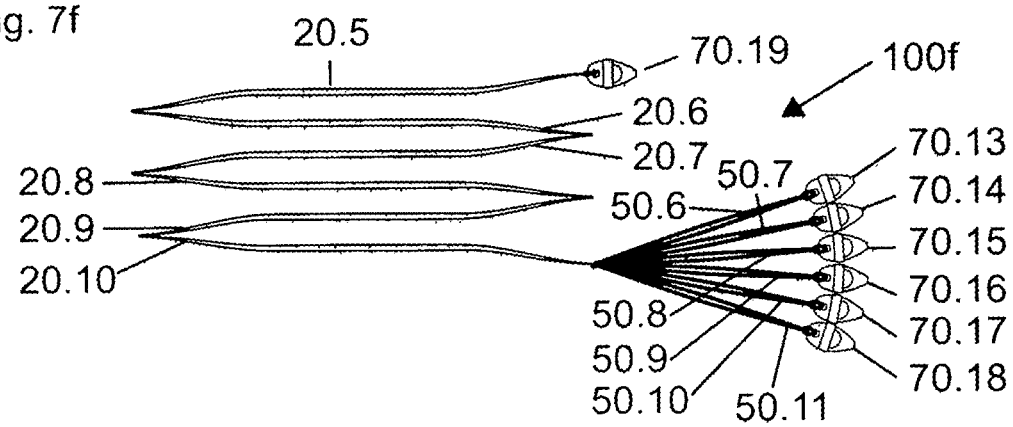

FIG. 7F shows a sixth alternate geometry (100*f*) of the toy according to the present invention where a bob (70.19) is attached to a hollow, cylindrical cross-section, loop tethering means (20.5), which may in turn be attached to one or more additional hollow, cylindrical cross-section, loop tethering means (20.6) through (20.10) in a chain geometry, and the final hollow, cylindrical cross-section, loop tethering means (20.10) is attached to plurality non-hollow, cylindrical cross-section, loop tethering means (50.6) through (50.10), with a bob (70.13) through (70.18) attached to each of the non-hollow loop tethering means (50.6) through (50.10) at ends on the non-hollow loop tethering means (50.6) through (50.10) distal to the ends attached to the final hollow, cylindrical cross-section, loop tethering means (20.10). It should be noted that although the embodiment (100*f*) of FIG. 7F is shown with a chain of six hollow, cylindrical cross-section, loop tethering means (20.6) through (20.10), the chain could of course consist of more or fewer hollow loop tethering means. Similarly, although the embodiment (100*f*) of FIG. 7F is shown with six non-hollow loop tethering means (50.6) through (50.10) terminating with six bobs (70.13) through (70.18), the number of non-hollow loop tethering means and bobs could be greater than or less than six.

Figure 7G:
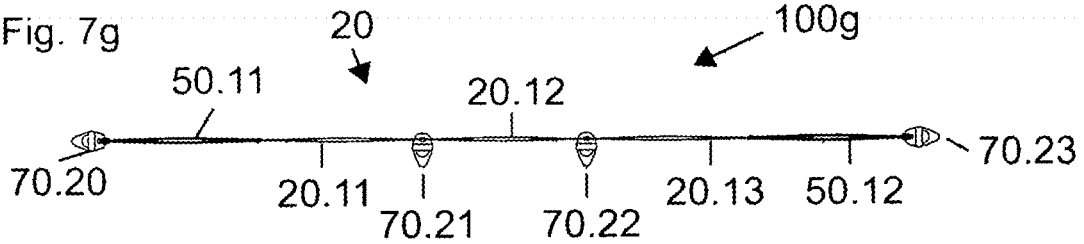

FIG. 7G shows a seventh alternate geometry (100*g*) of the toy according to the present invention where a bob (70.20) is attached to a first non-hollow, cylindrical cross-section, loop tethering means (50.11), the first non-hollow, cylindrical cross-section, loop tethering means (50.11) is attached to a first end of a coreless, cylindrical cross-section, loop tethering means (20), along the coreless, cylindrical cross-section, loop tethering means (20) are attached two bobs (70.21) and (70.22), attached to a second end of the coreless, cylindrical cross-section, loop tethering means (20) is a second non-hollow, cylindrical cross-section, loop tethering means (50.12), and attached to the second non-hollow, cylindrical cross-section, loop tethering means (50.12) is another bob (70.23). The central two bobs (70.21) and (70.22) are separated by a length (20.12) along the coreless, cylindrical cross-section, loop tethering means (20) equal to the distance from bob (70.21) to the end of the coreless, cylindrical cross-section, loop tethering means (20) attached to the first non-hollow, cylindrical cross-section, loop tethering means (50.11), as well as equal to the distance from bob (70.22) to the end of the coreless, cylindrical cross-section, loop tethering means (20) attached to the second non-hollow, cylindrical cross-section, loop tethering means (50.12).

Figure 7H:
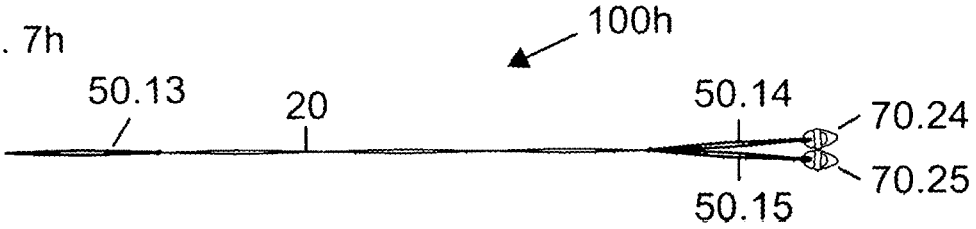
Figure 7I:
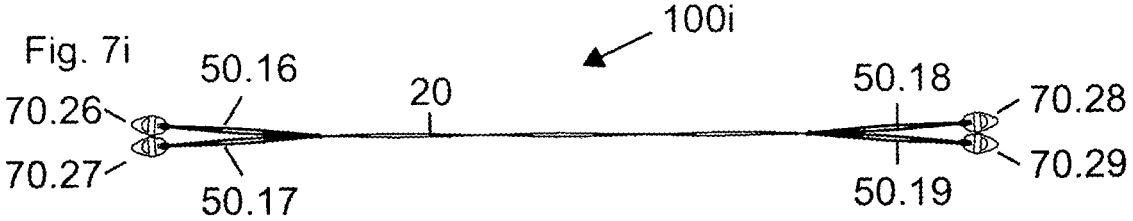

FIG. 7H shows an eighth alternate geometry (100*h*) of the toy according to the present invention where a first non-hollow, cylindrical cross-section, loop tethering means (50.13) is attached to a first end of a coreless, cylindrical cross-section, loop tethering means (20), attached to a second end of the coreless, cylindrical cross-section, loop tethering means (20) are second and third non-hollow, cylindrical cross-section, loop tethering means (50.14) and (50.15), and attached to the second and third non-hollow, cylindrical cross-section, loop tethering means (50.14) and (50.15) are bobs (70.24) and (70.25), respectively.

FIG. 7H shows a ninth alternate geometry (100*i*) of the toy according to the present invention where a first bob (70.26) is attached to a first non-hollow, cylindrical cross-section, loop tethering means (50.16), a second bob (70.27) is attached to a second non-hollow, cylindrical cross-section, loop tethering means (50.17), the first and second non-hollow, cylindrical cross-section, loop tethering means (50.16) and (50.17) are attached at ends distal to the bobs (70.26) and (70.27) to a first end of a coreless, cylindrical cross-section, loop tethering means (20), attached to a second end of the coreless, cylindrical cross-section, loop tethering means (20) are third and fourth non-hollow, cylindrical cross-section, loop tethering means (50.18) and (50.19), and attached to the third and fourth non-hollow, cylindrical cross-section, loop tethering means (50.18) and (50.19) are bobs (70.28) and (70.29), respectively.

Clearly, the modular nature of the toy of the present invention provided by the use of looped tethering segments allows for a large variety of geometries to be constructed. Players can therefore customize the geometry to suit various performance situations or the style of play desired by the player. It should also be noted that the quickness and easiness of altering the geometry is facilitated by the joining by half hitches of a section made of a material with a substantially cylindrical cross-section to a section made of a material with a substantially flat cross-section. Furthermore, an advantage of having a tethering means consisting of a section having a material with a substantially cylindrical cross-section and a material with a substantially flat cross-section is that the point of attachment of the two sections can be easily determined by feel.

According to the preferred embodiment of the present invention, the bobs (70) have a weight of 10.3 grams, the outer loop tethering means (50) have a loop length (i.e., a length along the circumference of the loop) of 50 cm and a weight of 1.7 grams, and the central loop tethering means (20) has a loop length of 155 cm and a weight of 4.25 grams. In optimizing the toy (100) of the present invention for a variety of types of play using a variety of configurations and a variety of holds on each configuration, the weights and dimensions have been optimized. The bobs (70) have a weight of preferably between 7 grams and 15 grams, more preferably between 8 grams and 13 grams, and still more preferably between 9 grams and 12 grams. The ratio of the loop length of the outer loop tethering means (50) to the loop length of the central loop tethering means (20) is between 0.2 and 0.6, more preferably between 0.25 and 0.45, and still more preferably between 0.30 and 0.4. The ratio of the weight of a bob (70) to the weight of the central loop tethering means (20) is preferably between 1 and 5, more preferably between 1.7 and 3.5, and still more preferably between 2 and 2.8. The ratio of the weight of a bob (70) to the weight of an outer loop tethering means (50) is preferably between 1 and 12, more preferably between 3.5 and 9, and still more preferably between 5 and 7. These preferred ranges, and the more particularly the weights and dimensions (including the widths of the tethering means (20) and (50)) used in the preferred embodiments specified above, provide important advantages in the balancing numerous factors and considerations important in play with the toy (100) of the present invention, even over a variety of configurations of the toy (100). Such factors and considerations include but are not limited to: air resistance, length and speed scales of play, the size of players, forces and tensions associated with play, etc.

Thus, it will be seen that the improvements presented herein are consistent with the objects and advantages of the invention described above. While the above description contains many specificities, these should not be construed as limitations on the scope of the invention, but rather as exemplifications of preferred embodiments thereof. Many other variations are possible. For example: the tethering means may not consist of loops; the bobs need not all have the same construction or the same weight; the bobs need not all have the same weight; the strings may not be made of nylon; the central and/or outer strings may have weaves of other geometries; the central and/or outer strings may or may not have cores or sheaths; the strings may have other numbers of yarns in the sheaths and cores; other types of knots may be used to form loops or secure the lights to the tethering means; loops of the tethering means may be formed by other means, such as metal clasps, glue, and so on; the strings, cords, or tethering means may not be made of a woven material; etc. Accordingly, the scope of the invention should be determined not by the embodiments illustrated, but by the appended claims and their legal equivalents.

What is claimed is:

1. A swinging bob toy comprising:

a first tethering means which forms a first loop;

a first bob, said first bob being attached to said first tethering means;

a second tethering means which forms a second loop; and a second bob, said second bob being attached to said second tethering means, said first tethering means being attached to said second tethering means wherein said first bob has a first aperture through which said first tethering means passes, said first bob being tethered to said first tethering means by a first knot formed by said first tethering means and said first aperture, said second bob has a second aperture through which said second tethering means passes, said second bob being secured to said second tethering means by a second knot formed by said second tethering means and said second aperture, and said first tethering means being secured to said second tethering means by a third knot formed by said first tethering means and said second tethering means, further including a third tethering means which forms a third loop, and a third bob having a third aperture through which said third tethering means passes, said third bob being tethered to said third tethering means by a fourth knot formed by said third tethering means and said third aperture, and said first tethering means being attached to said third tethering means by a fifth knot formed by said first tethering means and said third tethering means.

2. The swinging bob toy of claim 1 wherein said first tethering means has a first loop segment between said first bob and said second bob, and said first tethering means has a second loop segment between said second bob and said third bob.

3. The swinging bob toy of claim 2 wherein said second, third, fourth, and fifth knots are half hitches.

4. The swinging bob toy of claim 3 wherein said first knot is an overhand knot.

5. The swinging bob toy of claim 2 wherein said first, second, and third bobs each include a light emitter.

6. The swinging bob toy of claim 1 wherein said first tethering means has a nonhollow interior, said second tethering means has a first hollow interior, and said third tethering means has a second hollow interior.

7. The swinging bob toy of claim 6 wherein a first one end of a first material of said second tethering means is inserted into said first hollow interior of a first other end of said first material and a first region of overlap of said first one end and said first other end is sewn together, and a second one end of a second material of said third tethering means is inserted into said second hollow interior of a second other end of said second material and a second region of overlap of said second one end and said second other end is sewn together.

* * * * *